US012492040B2

(12) United States Patent
Brinkers

(10) Patent No.: US 12,492,040 B2
(45) Date of Patent: Dec. 9, 2025

(54) STACKABLE AND NESTABLE CONTAINER

(71) Applicant: Schoeller Allibert GmbH, Schwerin (DE)

(72) Inventor: Erik Brinkers, Emmen (NL)

(73) Assignee: Schoeller Allibert GmbH, Schwerin (DE)

( * ) Notice: Subject to any disclaimer, the term of this patent is extended or adjusted under 35 U.S.C. 154(b) by 61 days.

(21) Appl. No.: 18/279,143

(22) PCT Filed: Mar. 30, 2022

(86) PCT No.: PCT/EP2022/058417

§ 371 (c)(1),
(2) Date: Aug. 28, 2023

(87) PCT Pub. No.: WO2022/228810

PCT Pub. Date: Nov. 3, 2022

(65) Prior Publication Data

US 2024/0140646 A1 May 2, 2024

(30) Foreign Application Priority Data

Apr. 26, 2021 (EP) ..... 21170467

(51) Int. Cl.
*B65D 21/06* (2006.01)

(52) U.S. Cl.
CPC ..... *B65D 21/06* (2013.01)

(58) Field of Classification Search
CPC ..... B65D 21/06; B65D 21/066
USPC ..... 206/506
See application file for complete search history.

(56) References Cited

U.S. PATENT DOCUMENTS 5,501,336 A * 3/1996 De Maria ..... B65D 21/0233 206/505

FOREIGN PATENT DOCUMENTS

| | | |
|---|---|---|
| BE | 842929 A | 10/1976 |
| EP | 0655393 A1 | 5/1995 |
| EP | 2014561 B1 | 9/2011 |

OTHER PUBLICATIONS

Search Report received in European Application No. 21170467.1-1017 dated Oct. 12, 2021, with translation, 11 pages.
Search Report received in International Application No. PCT/EP2022/058417 dated Sep. 5, 2022, with translation, 6 pages.

* cited by examiner

*Primary Examiner* — Andrew D Perreault
(74) *Attorney, Agent, or Firm* — Christopher A. Rothe; CM Law

(57) ABSTRACT

A container includes a base and conically formed, hollow corner columns that project from the base and are open on the underside of the base. Corner columns of another, structurally identical or compatible container can penetrate into the hollow corner columns of the container from the underside of the base, so that the two containers can be nested. The corner columns can be closed by a slide element so that the container can be stacked on the corner columns of the other container. A side wall projects from the base and is open on the underside of the base. The sidewall is between two corner columns such that a side wall of the other container can penetrate into the side wall from the underside of the base to nest the two containers. The side wall and the corner columns can be closed at the base by a slide element.

18 Claims, 2 Drawing Sheets

STACKABLE AND NESTABLE CONTAINER

CROSS-REFERENCE TO RELATED APPLICATIONS

This application is the United States national phase entry of International Application No. PCT/EP2022/058417, filed Mar. 30, 2022, and claims priority to European Application No. 21 170 467.1, filed Apr. 26, 2021. The contents of International Application No. PCT/EP2022/058417 and European Application No. 21 170 467.1 are incorporated by reference herein in their entireties.

FIELD

The present disclosure relates to a container that is both nestable when it is empty as well as stackable when goods are received in the container.

BACKGROUND

Various types of stackable and nestable containers are known from the prior art. For example, there are rotary stacking containers which are asymmetrical and can be stacked on top of each other in one orientation and can be nested inside each other in another orientation. Furthermore, there are conical containers with stacking brackets that can be pivoted inward and outward so that the containers can be nested inside each other when the stacking brackets are pivoted outward and can be stacked on top of each other on the stacking brackets when they are pivoted inward.

EP 2 014 561 B1 describes a stackable and nestable transport tray. For this purpose, the tray has four corner columns which project away from a base plate. The four corner columns have four openings at the base through which the corner columns of another tray can be inserted. This way, the two trays can be nested into each other. If the trays contain goods and are therefore to be stacked, the openings can be closed by sliding plates. Thus, one tray can be stacked on the corner columns of the lower tray.

All of the above types have disadvantages.

Rotating stacking containers have the disadvantage that they can only be nested or stacked in a certain orientation of the containers to each other, which makes their handling more complicated or places higher demands on an automated logistics process. Due to the asymmetrical design, the loading area is usually also asymmetrical, which makes loading the container more difficult.

Containers with rotating stacking brackets have the disadvantage that the stacking brackets are only able to bear lower loads than the container walls, so that when stacking the containers, attention has to be paid to the total load, which in particular acts on the stacking brackets of the lowest container. Furthermore, the stacking brackets may hinder loading if they inadvertently swing inward.

The tray disclosed in EP 2 014 561 B1 has the disadvantage that the tray has no sidewalls. The corner columns of the tray are fragile and can be bent/damaged and goods, in particular piece goods, can fall out of the open tray or be damaged. Particularly during transport or storage, objects can penetrate between the corner columns of the tray into the interior of the tray and damage the goods in the tray or cause them to fall out.

The object of the disclosure is therefore to overcome the disadvantages of the prior art and to provide a container which is both stackable and nestable and which has a necessary stability and protects the goods inside the container.

SUMMARY

The present disclosure relates to a stackable and nestable container, in particular a plastic container, comprising a base and conically formed, hollow corner columns open on the base underside and projecting from the base. The corner columns are configured such that corner columns of another identically constructed or compatible container can be inserted into the hollow corner columns from the base underside for nesting the two containers, wherein the corner columns open on the base underside are closable with at least one closure element, in particular a slide element, in order to be able to stack the container on the corner columns of the other container. At least between two adjacent corner columns, a conically constructed, double-walled sidewall open on the base underside and projecting from the base is provided in such a way that a sidewall of the other identically constructed or compatible container can enter into the double-walled sidewall from the base underside to nest the two containers. The sidewall open on the base underside is closable by a slide element. Two adjacent corner columns and the sidewall arranged between them are closable at the base side by the same slide element.

In other words, a container has a base and corner columns which are conical, hollow and open at the base underside. The corner columns protrude from the base. The container is preferably made of plastic. The corner columns are hollow so that corner columns of a further container, which is identical to the first container, can be inserted into the corner columns of the first container. The corner columns are inserted from the openings in the base underside. By inserting the corner columns of the other container into the corner columns of the first container, the two containers are nested into each other.

The corner columns open at the base side are closable by a slide element in order to stack the first container on the corner columns of the other container. When the containers are nested, the slide element is pushed in such a way that it does not cover the open corner columns. The container has one or more sidewalls. One sidewall is formed between two adjacent corner columns. The sidewall narrows toward the top and is double-walled and hollow on the inside. The sidewall protrudes from the base. In order to nest the two containers, the sidewall of the other container is inserted from the base underside into the hollow sidewall of the first container.

By nesting several containers, space can be saved when storing the containers. Since multiple nested containers do not require significantly more space than a single container, transportation and storage costs can be saved.

According to another aspect of the disclosure, the sidewall open on the base underside is closable by a closure element. The closure element is preferably a slide element.

In other words, the sidewall open on the base underside has an opening on the base underside. The opening is closable by a closure element. The closure element is preferably a slide element that is attached to the base underside. The slide element can be pushed by a user into a position such that the sidewall open on the base underside is closed or covered. The sidewall open on the base underside is covered when two containers are to be stacked. The closure element covers the sidewall open on the base underside when the closure element is pushed completely outward, i.e. against the direction toward the center of the container. The position in which the closure element is pushed completely outward is the outer position.

If the sidewall open on the base underside is covered, the closure element is pushed completely outward. If the sidewall open on the base underside is not to be covered but open, the closure element is pushed to the center of the container. The position in which the closure element is pushed toward the container center is the inner position.

According to a further aspect of the disclosure, the two adjacent corner columns and the sidewall arranged therebetween are closable at the base side by the same closure element.

In other words, two adjacent corner columns and a sidewall formed between the corner columns form a common sidewall. The common sidewall has a common opening on the base underside. The common opening is closable by a common closure element. This means that a composite of two adjacent corner columns and an interjacent sidewall is always closable by a common closure element. Corner columns that are not adjacent cannot be closed by the same closure element. This means that the container can be stacked not only on the corner columns but also on the sidewalls of the other container. In this way, when stacked, the loads can be supported not only by the corner columns but also by the sidewalls.

According to a further aspect of the disclosure, the closure element is displaceably mounted on the base underside and parallel thereto, in particular within a base rim projecting from the base underside. Thereby, the closure element is preferably displaceably mounted toward the center of the container and/or between two stops.

In other words, the container has a (base) rim that extends downward beyond the base of the container. This means that when the container stands on the base, it is not the base or the closure elements that touch the base, but the rim. The closure element is mounted inside the rim. The closure element is slidably mounted on the base underside or offset parallel thereto. Preferably, the closure element is movable (toward the center of the container) when the container is standing with its base rim on a surface.

According to a further aspect of the disclosure, the closure element is actuatable from the outside via a recess in the sidewall, is in particular displaceable inward, and/or is actuatable from the inside via a recess in the base, is in particular displaceable outward.

In other words, the sidewall and/or the base has a recess. Through this recess, an actuating element can be pushed inward on the closure element. In doing so, the actuating element enters the space of the container. Thus, the closure element is pushed toward the center of the container and the openings are open. If the openings are to be closed, the closure elements can be pushed outward. For this purpose, the actuating element protrudes through a recess in the base of the container into the interior of the container. From the inside of the container, the actuating element and with it the closure element can be pushed outward.

According to a further aspect of the disclosure, the closure element has on its underside, a profile or an indentation which corresponds to the shape of the corner columns and/or of the sidewalls in such a way that, in the stacked state, the corner columns and/or the sidewalls engage in a form-fitting manner in the profile or the indentation and containers stacked one on top of the other do not slip sideways.

The closure element has a profile on its underside. The profile is L-shaped, for example. The shape of the corner columns and/or of the sidewall is configured in such a way that the shape matches the profile of the closure element. Since the shape of the corner columns or of the sidewall is inserted into the indentation, the stacked containers are secured against slipping.

According to another aspect of the disclosure, the container has four corner columns and two opposite, preferably long, sidewalls, wherein one sidewall and its two adjacent corner columns are closable at the base side by a first closure element and the other sidewall and its two adjacent corner columns are closable at the base side by a second closure element.

In other words, the container has two sidewalls. The sidewalls are arrange opposite to each other. Preferably, the sidewalls are formed on the long side of the container. The sidewalls are terminated at the ends by the corner columns. Thus, the container has four corner columns. A composite of one sidewall and two corner columns is closed in each case by a closure element. The other sidewall and its corner columns are closed by another closure element.

According to another aspect of the disclosure, the container comprises a gripping handle in the sidewall. The gripping handle is configured to facilitate lifting the container for a user. The gripping handle does not prevent nesting of multiple containers. For example, the gripping handle may penetrate the sidewall to allow the user to reach through the sidewall with their hand. However, the gripping handle may also form an indentation in the sidewall by which the user can lift the container.

In other words, the sidewall of the container has a handle. The handle is provided for ergonomic lifting of the container. The handle may be an indentation in the sidewall, but also a continuous recess in the sidewall.

According to a further aspect of the disclosure, the closure element comprises a locking mechanism by which the closure element, when pushed fully toward the center of the container and/or fully outward, is locked in this position. The locking mechanism may be implemented, for example, via latches or a clamp connection. The locking mechanism is configured in such a way that it locks in place when the closure element is pushed all the way to the center of the container and prevents the closure element from slipping outward again or being displaced. The locking mechanism also locks in place when the closure element is pushed completely outward. This prevents the closure element from sliding back inward from the outside toward the center of the container and releasing the openings.

In other words, the closure element is prevented from slipping out of an extreme position by itself. An extreme position is a position in which the closure element is either deflected as far as possible toward the center of the container or pushed outward as far as possible. In these positions, the closure element has to be securely attached so that the openings are not released during stacking, for example. This is ensured by the locking mechanism. Each of the extreme positions has its own locking mechanism.

According to a further aspect of the disclosure, the corner columns and/or the sidewall comprise a stop element/or a stop/or a stacking edge that prevents the corner column of the other container from completely entering the corner column of the container or limits the nest depth. The stop element is, for example, one or more longitudinal ribs or a column which is formed inside the corner column in such a way that the other corner column rests on the stop element when it enters the corner column. This prevents the other corner column from entering the corner column completely.

In other words, the corner columns have an element inside them. The element is prepared in such a way that another corner column, which is inserted into the corner column, rests on the element and is thus stopped. The element stops the other corner column so that the corner column cannot completely enter the corner column.

If both nested containers are wet, for example after cleaning, complete insertion of the corner columns into each other can result in the side surfaces of the corner columns resting on each other and being difficult to separate again. This is prevented by the stop element.

According to another aspect of the disclosure, the actuating element of the closure element is hollow toward the outside. That is, the actuating element forms a recessed grip into which the user can reach and actuate the closure element. The actuating element protrudes upward from the closure element. The actuating element is configured in such a way that, in the inner position, it can be pushed outward from the inside of the container and can also be pulled outward from the outside of the container.

In other words, the user can reach into the hollow actuating element and pull the actuating element outward. The hollow actuating element allows the user to pull the actuating element outward from outside the container when the actuating element is at the inner position. This is advantageous since the user has difficulty reaching inside the container due to the sidewall.

According to another aspect of the disclosure, the container, base plate, and sidewalls are integrally made of plastic. For example, the container is made in one piece by injection molding.

According to a further aspect of the disclosure, the double-walled sidewall is not flat but is provided with reinforcing geometries, in particular in the form of indentations and elevations or beads. These are prepared to increase the stability of the sidewall. The reinforcing geometries are such that they allow nesting, in particular they are set at an angle in the height direction.

According to another aspect of the disclosure, the closure element is releasably attached to the base of the container without the use of a tool. In other words, the user can detachably mount the closure element to the base underside of the container using only his hands and without the use of a tool. For this purpose, the closure element can be fixed by detents or securing lugs, respectively, and can be removed or replaced by the user by squeezing them together. This makes it easy to change the closure element.

According to another aspect, the present disclosure relates to a stackable and nestable container, in particular a plastic container, comprising a base and at least two conical and double-walled sidewalls open on the base underside and projecting from the base, so that corresponding sidewalls of another identically constructed or compatible container can enter into the double-walled sidewalls from the base underside for nesting the two containers. The sidewalls open on the base underside are closable with one or more closure elements so that the container can be stacked on the sidewalls of the other container.

In other words, the container has only sidewalls, but no corner columns. The sidewalls are conical, double-walled, hollow and open at the base underside. This creates an opening on the base underside of the container. The sidewalls are configured in such a way that sidewalls of another container of identical construction or compatibility can enter the hollow sidewalls of the container from the base underside. The sidewalls open on the base underside are closable with a closure element. This means that the sidewalls of the other container cannot enter the sidewalls of the first container and the closure elements of the first container rest on the sidewalls of the other container to stack the two containers on top of each other.

DETAILED DESCRIPTION

Embodiments of the present disclosure are described below based on the accompanying figures.

Figure 1:
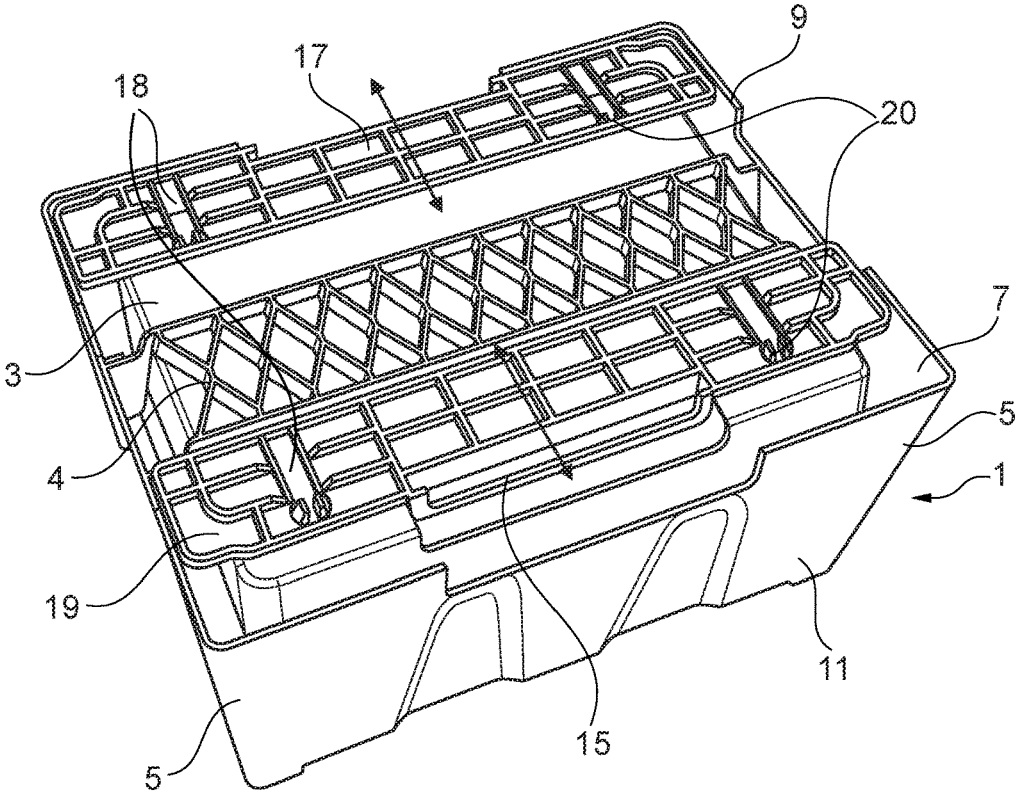
FIG. 1 is a representation illustrating an underside of the container and a slider plate covering openings of the container.

The container 1 according to the disclosure is described with reference to FIGS. 1 to 3. The substantially rectangular container 1 has a base 3 and four corner columns 5 projecting from the base 3. The corner columns 5 are conical, hollow and open at the base underside. The corner columns 5 are drawn around the respective corner or, respectively, have approximately an L-shape. FIG. 1 shows a base underside of the container 1. A crosspiece 4 extending in the longitudinal direction of the container 1 is formed centrally on the base underside. The crosspiece 4 is formed by reinforcing ribs arranged in a grid shape. It is furthermore shown that the corner columns 5 open at the base underside have openings 7 on the base underside of the container 1. The base underside has a base rim 9, which, together with the crosspiece 4, forms the footprint. This means that when the container 1 is standing on a surface, the crosspiece 4 and the base edge 9 of the container 1 come into contact with the surface.

On the long sides of the container 1, long (high) sidewalls 11 are formed between the corner columns 5. On the short sides, the container 1 is open and the base 3 is limited only by short (low) side rims 12.

The sidewalls 11 and side rims 12 are conical, double-walled and open on the base underside.

As can be seen from FIG. 1, a respective slider plate 17 is displaceably arranged or mounted on the base underside on both sides of the crosspiece 4, so that each slider plate 17 can be displaced transversely to its longitudinal extension between the crosspiece 4 and the base rim 9 of the long side of the container 1. In other words, each slider plate 17 can be displaced transversely to the longitudinal extension of the container 1.

The slider plate 17 forms a closure element, with which the corner columns 5 open on the base underside and sidewalls 11 can be selectively closed and opened.

When the slider plate 17 is pushed completely to the center of the container or to the crosspiece 4, respectively, the corner columns 5 open on the base underside and the sidewalls 11 open on the base underside are open. When the slider plate 17 is pushed completely outward or toward the base rim 9, respectively, the corner columns 5 open on the base underside and the sidewalls 11 open on the base underside are covered or closed (see arrows in FIG. 1).

Each slider plate 17 has two apertures or elongated holes 18 extending in the transverse direction, in each of which two detents or securing lugs 20 formed on the base 3 of the container engage. The two securing lugs 20 face each other and fix the slider plate 17 to the base underside of the container 1. The securing lugs 20 have projections that releasably fix the slider plate 17. The interaction of the elongated holes 18 and the securing lugs 20 guides the displacement of the slider plate 17. Furthermore, the slider plates 17 also still slide along the short side of the container 1 with their short end faces on the inside of the base rim 9 to prevent the slider plate 17 from jamming. In order to release the slider plate, for example to replace the slider plate 17, the securing lugs 20 are compressed by the user. As a result, the projections of the securing lugs 20 are pressed inward and the securing lugs 20 slide through the elongated hole 18. As a result, the slider plates are detachable and can be released by the user without tools. The securing lugs 20 are furthermore beveled so that the slider plate 17 can be easily pressed onto the securing lugs 20 during assembly. In this way, the user can mount the slider plate 17 without tools and can also release it again.

The slider plate 17 does not necessarily have to be fixed to the base 3 of the container 1 by the securing lugs 20. Alternatively, it is also conceivable that a protruding sliding block or pilot pins formed on the base 3 engage(s) in the elongated hole 18. In this case, the pilot pins are T-shaped and thus hold the slider plates 17 on the base underside of the container 1.

In order to attach the separate or separately manufactured slider plates 17 to the base underside of the container 1, these are placed at the points provided for this purpose on the base underside and the pilot pins are subsequently inserted from below through the elongated holes 18 and connected to the base 3 of the container 1, e.g. via a click connection. By releasing the pilot pins, the slider plates 17 can be detached from the container 1 again and can be replaced if applicable.

The height of the slider plates 17 is less than the crosspiece 4 and the base rim 9, so that when the container 1 stands on a lower surface, the slider plates 17 are spaced from this lower surface and are thus freely movable or displaceable.

The slider plate 17 has (L-shaped) indentations 19 on the underside, i.e. the side facing away from the container 1. The indentations 19 are configured in such a way that the shape of the (L-shaped) corner columns 5 of an identical container 1 on which the container 1 is stacked fits into the base indentations 19 of the slider plates 17 and the corner columns 5 of the lower container 1 engage in the indentations 19 of the container 1 stacked above. The indentations 19 may also be—as shown in FIG. 1—corresponding recesses in reinforcing ribs on the underside of the slider plates 17.

In order to move the slider plates 17, each has a raised rim border 15 on the side facing the sidewall 11, which serves as a gripping or actuating element for the slider plate 17.

The base 3 has recesses 13 on both long sides through which the rim borders 15 of the slider plates 17, which are displaceably attached to the base underside, pass in order to be able to actuate the slider plates 17 on the underside of the container via the projecting rim borders 15, which extend into the interior of the container.

Furthermore, each sidewall 11 has a recess 13 in the center of the lower area or, respectively, in the transition area between sidewall 11 and base 3 to allow the rim borders to be pushed laterally outward and inward and not to block the sliding movement of the slider plates 17. The recess 13 corresponds in shape and size to the shape and size of the respective rim border 15.

In this way, the rim border 15 can be moved from the outside through the recess 13 to the inside and thus the slider plate 17 to the center of the container or to the crosspiece 4, respectively, and vice versa from the inside to the outside in order to move the slider plate 17 to the outside or to the base rim 9, respectively. In the position pushed to the outside, the rim border 15 is flush with the sidewall 11 or, respectively, completely fills the recess 13.

The slider plate 17 can preferably be fixed or locked at the position close to the center of the container and at the outer position. For this purpose, the base 3 and/or the slider plate 17 have locking elements that cooperate with each other (not shown). The locking elements can be configured either as clamp connections or snap-in connections. The slider plate 17 is held in the respective position so that it does not slip out of position.

Figure 2:
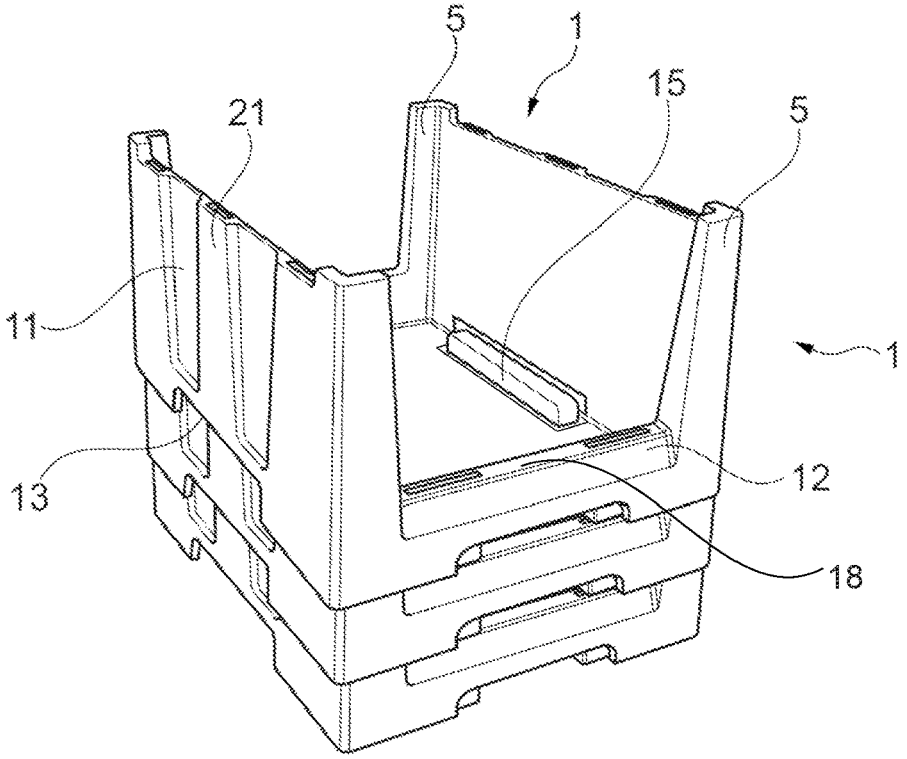
FIG. 2 is a representation illustrating three containers nested within each other.

FIG. 2 shows three containers nested inside each other. When the closure element 17 is pushed to the center of the container and the corner columns 5 open on the base underside and the sidewalls 11 open on the base underside, the corner columns 5 and sidewalls 11 of another identically constructed or compatible container 1 can enter the hollow corner columns 5 and sidewalls 11 from the base underside. This causes the two containers to nest. The corner columns 5 of the other container 1 disappear completely into the hollow corner columns 5 of the first container. The base underside of the first container 1 then rests on the base 3 of the other container 1. The sidewalls 11 of the other container 1 are inserted into the sidewalls 11 open on the base underside of the first container 1 in the same way as the corner columns 5. On the short side of the nested containers 1, the containers 1 form handles 23. The handles 23 make it possible to lift the containers 1 conveniently or, respectively, to remove the upper container 1 from a stack of containers 1.

The two nested containers 1 require only slightly more space for storage than a single container. This saves storage and transport costs. It is obvious that in this way not only two containers can be nested into each other, but more than two containers can be nested.

By actuating the actuating elements 15 projecting inward into the container interior, the closure elements 17 are pushed outward. For this purpose, the actuating elements 15 are pushed from the inside to the outside through the recesses 14 in the container base 3. The closure elements 17 are moved with the respective actuating element 15. This closes the openings of the corner columns 5 open on the base underside and the sidewalls 11 open on the base underside.

Figure 3:
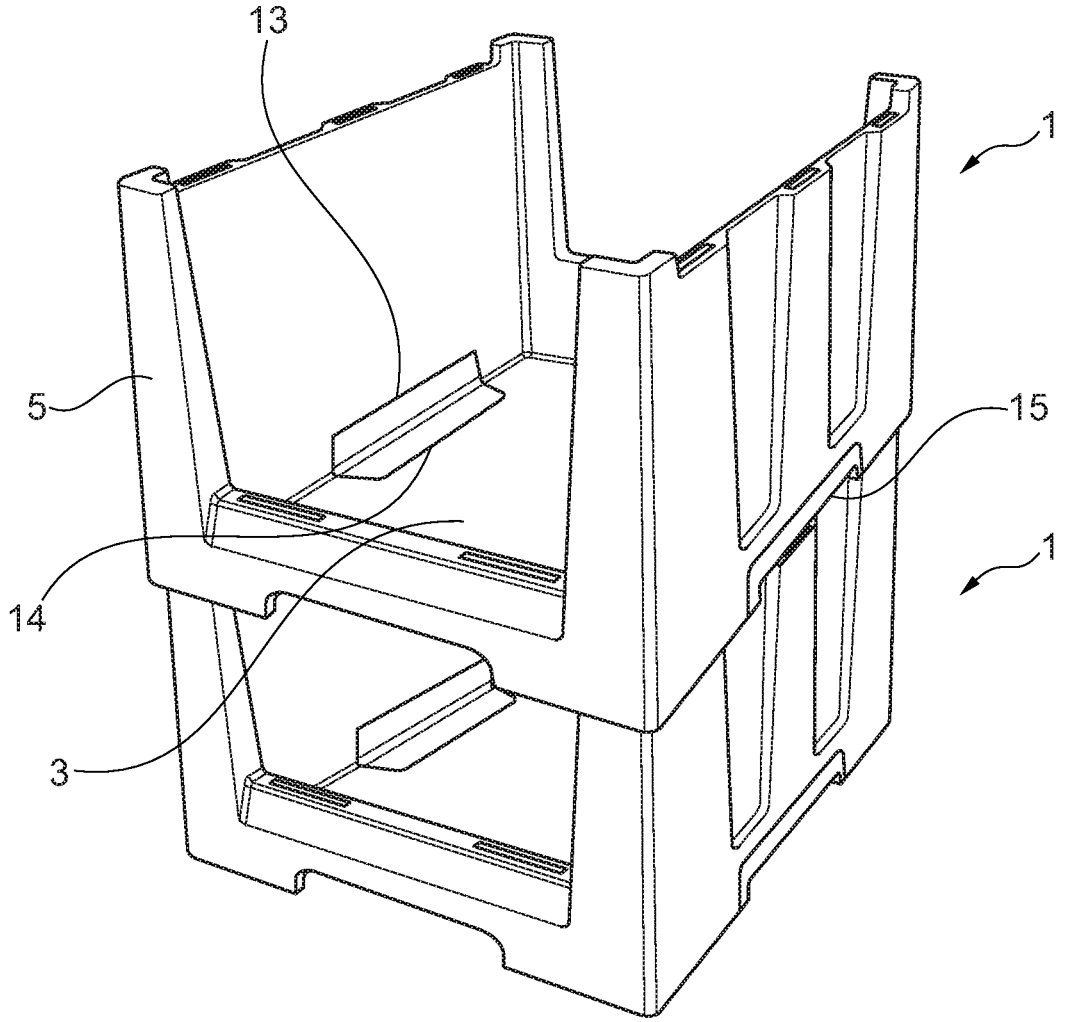
FIG. 3 is a representation illustrating two containers stacked on top of each other.

FIG. 3 shows two stacked containers 1. When the closure element 17 is pushed completely outward, it covers the corner columns 5 open on the base underside and the sidewalls 11 open on the base underside. This means that the base underside is no longer open. As a result, the corner columns 5 of the other container 1 can no longer enter into the hollow corner columns 5 of the container. Instead, the corner columns 5 rest against the closure element 17 of the container. This allows the containers 1 to be stacked on top of each other. The closure element 17 of the container 1 rests on the upper ends of the corner columns 5 of the other container 1. The shape of the corner columns 5 of the other container fits the shape of the indentations 19 on the closure element 17 of the first container 1. The two stacked containers 1 are thus pushed together and secured against slipping in a direction parallel to the container base 3. The base rim 9 of the base underside protrudes beyond the container base 3 and the closure element 17. For this reason, the base rim 9 also encompasses the upper end of the corner columns 5. This also prevents the stacked containers 1 from slipping.

The sidewalls 11 of the container have one or more struts 21. The struts 21 are attached to the outside of the sidewalls 11 in a vertical direction. Preferably, a sidewall 11 has three struts 21, one in the middle of the sidewall 11 and one at each end of the sidewall next to the corner columns 5. The struts 21 are hollow on the inside and are configured in such a way that the struts 21 of another sidewall can be nested in the crosspieces. The struts 21 increase the stability of the sidewall 11.

When the containers 1 are stacked, goods can be stored/received in the lower container 1 without the goods being damaged by the upper container 1. The goods in the container 1 are thus protected by the upper container 1 against damage from above and by the sidewalls 11 against damage from the side. Furthermore, the sidewalls 11 prevent goods from falling out of the container 1 to the side. It is obvious that in this way not only two containers 1 can be stacked on top of each other, but more than two containers 1 can be stacked.

The containers 1 are preferably manufactured as a single component. Preferably, the containers 1 are made of a plastic and manufactured by injection molding.

It is obvious that the container 1 may have a different number of sidewalls 11 depending on the use and requirements. Thus, it is possible that the container has only one (short) sidewall. However, the container may also have three or four sidewalls.

In a modified embodiment (not shown), the container also has a base and at least two (opposite) sidewalls, but no corner columns. The sidewalls project from the base, are conical and double-walled and open on the base underside so that corresponding sidewalls of another identically constructed or compatible container and corresponding orientation for nesting the two containers can enter the double-walled sidewalls from the base underside. The sidewalls open on the base underside may also be closed with a slider plate in each case so that the container can be stacked on the sidewalls of the other container.

The invention claimed is:

1. A container configured to be stackable and nestable with a second container constructed identically to or compatible with the container, the container comprising:

a base having a base underside; and corner columns that are conically formed and hollow, the corner columns being open on the base underside and projecting from the base, the corner columns configured to receive corner columns of the second container by insertion from the base underside of the container to nest the container with the second container, the container comprising at least one sidewall that projects from the base, the at least one sidewall being double-walled, conically constructed, and open on the base underside, the at least one sidewall configured to receive a second sidewall of the second container by insertion from the base underside of the container to nest the container with the second container, and at least two of the corner columns of the container and the at least one sidewall being closable at the base underside with at least one slide element to facilitate stacking the container on the corner columns of the second container, the at least one slide element being movable towards a center of the container to a first position and movable away from the center of the container to a second position, the base and the at least one sidewall comprising at least one recess, the at least one recess forming a stop at the base when the at least one slide element is positioned in the first position, and an actuating element of the at least one slide element being positioned at least partly inside the at least one recess in the first position, and being actuatable from inside the container via the at least one recess.

2. The container according to claim 1, wherein the at least one slide element is mounted on the base underside and displaceable parallel to the base underside.

3. The container according to claim 2, wherein the at least one slide element is displaceably mounted within a base rim projecting from the base underside.

4. The container according to claim 2, wherein the at least one slide element is displaceable between the stop at the first position and a stop at the second position.

5. The container according to claim 1, wherein the at least one slide element is actuatable from outside the container via a recess in the at least one sidewall.

6. The container according to claim 1, wherein the at least one slide element is movable inwardly from outside the container via the at least one recess in the at least one sidewall.

7. The container according to claim 1, wherein the at least one slide element comprises an underside and a profile or indentation on the underside, the profile or indentation corresponding to a geometry of the corner columns and/or of the at least one sidewall, wherein the container is prevented from slipping sideways relative to the second container when the container is stacked on top of the second container.

8. The container according to claim 1, wherein:

the corner columns comprise a first corner column, a second corner column, a third corner column and a fourth corner column, the at least one sidewall comprising a first sidewall between the first corner column and the second corner column, the at least one sidewall further comprising a second sidewall between the third corner column and the fourth corner column, the at least one slide element comprises a first slide element and a second slide element, the first corner column, second corner column and first sidewall being closable at the base underside by the first slide element, and the third corner column, fourth corner column and second sidewall being closable at the base underside by the second slide element.

9. The container according to claim 8, wherein the container has a rectangular shape with a first short side, a second short side opposite the first short side, a first long side, and a second long side opposite the first long side, the first long side comprising the first sidewall, and the second long side comprising the second sidewall.

10. The container according to claim 1, wherein the at least one sidewall comprises gripping handles.

11. The container according to claim 1, wherein the at least one slide element comprises a locking mechanism configured to lock the at least one slide element in the first position or in the second position.

12. The container according to claim 1, wherein the corner columns and/or the at least one sidewall comprise at least one stop that prevents the corner columns of the second container from being inserted completely into the corner columns of the container, or prevents the second sidewall of the second container from being inserted completely into the at least one sidewall of the container.

13. The container according to claim 1, wherein the base, the corner columns and the at least one sidewall are integrally manufactured by injection molding.

14. The container according to claim 1, wherein the at least one sidewall has reinforcing geometries in order to increase stability of the at least one sidewall.

15. The container according to claim 14, wherein the reinforcing geometries are beads or indentations and elevations.

16. The container according to claim 1, wherein the at least one slide element is releasably attached to the base without using tools.

17. The container according to claim 1, wherein the container is a plastic container.

18. A container configured to be stackable and nestable with a second container constructed identically to or compatible with the container, the container comprising:

a base having a base underside; and at least two first sidewalls that are conical, double-walled and open on the base underside and that project from the base, the at least two first sidewalls configured to receive second sidewalls of the second container by insertion from the base underside for nesting the container and the second container, the at least two first sidewalls each being closeable with at least one slide element so that the container is stackable on the second sidewalls of the second container, the at least one slide element being movable towards a center of the container to a first position and movable away from the center of the container to a second position, the base and the at least two first sidewalls comprising at least one recess, the at least one recess forming a stop at the base when the at least one slide element is positioned in the first position, and an actuating element of the at least one slide element being positioned at least partly inside the at least one recess in the first position, and being actuatable from inside the container via the at least one recess.

* * * * *